US009972456B2

(12) United States Patent
Reich et al.

(10) Patent No.: US 9,972,456 B2
(45) Date of Patent: May 15, 2018

(54) PULL-OUT SWITCH ASSEMBLY WITH REPLACEABLE SWITCH MODULE

(71) Applicant: Maschinenfabrik Reinhausen GmbH, Regensburg (DE)

(72) Inventors: Alexander Reich, Mintraching (DE); Simon Flotzinger, Aufhausen (DE); Nikolaus Unterreiner, Regensburg (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days. days.

(21) Appl. No.: 15/110,743

(22) PCT Filed: Feb. 13, 2015

(86) PCT No.: PCT/EP2015/053120

§ 371 (c)(1),
(2) Date: Jul. 10, 2016

(87) PCT Pub. No.: WO2015/124508

PCT Pub. Date: Aug. 27, 2015

(65) Prior Publication Data

US 2016/0351352 A1 Dec. 1, 2016

(30) Foreign Application Priority Data

Feb. 21, 2014 (DE) ..... 10 2014 102 263

(51) Int. Cl.

| | |
|---|---|
| ***H01H 9/08*** | (2006.01) |
| ***H01H 9/00*** | (2006.01) |
| ***H01F 29/02*** | (2006.01) |

(52) U.S. Cl.

CPC ..... *H01H 9/0016* (2013.01); *H01F 29/025* (2013.01); *H01H 9/0027* (2013.01); *H01H 9/0044* (2013.01); *H01H 9/08* (2013.01)

(58) Field of Classification Search

CPC .. H01H 9/0016; H01H 9/0005; H01H 9/0044; H01F 29/04

USPC ..... 200/289, 11 TC, 50.21

See application file for complete search history.

(56) References Cited

U.S. PATENT DOCUMENTS

| | | | | |
|---|---|---|---|---|
| 3,739,111 | A | 6/1973 | Wittenzellner | |
| 3,783,209 | A * | 1/1974 | Cleaveland | H02B 11/133 200/50.25 |
| 4,002,865 | A * | 1/1977 | Kuhn | H02B 11/133 200/50.22 |
| 4,532,386 | A | 7/1985 | Muench | |
| 7,910,845 | B2 * | 3/2011 | Kozar | H02B 11/133 200/50.21 |

(Continued)

*Primary Examiner* — Vanessa Girardi

(74) *Attorney, Agent, or Firm* — Andrew Wilford

(57) ABSTRACT

The invention relates to a switching device, in particular an on-load tap changer, having a housing and at least one exchangeable switching module. The switching device (1), in particular on-load tap changer, comprises a housing (2); an exchangeable switching module (3, 3', 3"); a fixed contact (20) arranged inside the housing (2); a guide rail (25) arranged inside the housing (2). The switching module (3, 3', 3") has a movable contact (10) that can be releasably connected to the fixed contact (20). The switching module (3, 3', 3") has a lower distribution plate (51) that is movably connected to the guide rail (25).

9 Claims, 6 Drawing Sheets

(56) References Cited

U.S. PATENT DOCUMENTS

| | | | | |
|---|---|---|---|---|
| 8,153,916 | B2 | 4/2012 | Lindsey | |
| 8,993,904 | B2 * | 3/2015 | Elick | H01H 1/18 200/11 TC |

* cited by examiner

PULL-OUT SWITCH ASSEMBLY WITH REPLACEABLE SWITCH MODULE

CROSS REFERENCE TO RELATED APPLICATIONS

This application is the US-national stage of PCT application PCT/EP2015/053120 filed 13 Feb. 2015 and claiming the priority of German patent application 102014102263.7 itself filed 21 Feb. 2014.

FIELD OF THE INVENTION

The invention relates to a switch assembly, particularly an on-load tap changer, having a housing and at least one replaceable switch module.

BACKGROUND OF THE INVENTION

On-load tap changers employing mechanical switching contacts, which are in oil or in a vacuum, for switching over from one winding tap of a tapped transformer to an adjacent winding tap are known from the prior art. However, new on-load tap changers use semiconductor switches for these switching-over actions. Not only maintenance of, but also repairs to such semiconductor switches are expensive and time-intensive and represent a significant challenge.

OBJECT OF THE INVENTION

Against this background it is an object of the invention to provide a switch assembly that enables simple, economic and rapid maintenance.

SUMMARY OF THE INVENTION

This object is attained by a switch assembly, particularly an on-load tap changer, comprising:

a housing;

at least one exchangeable switch module;

at least one fixed contact inside the housing; and at least one guide rail inside the housing;

wherein:

each switch module has at least one movable contact that can be releasably connected with at least one of the fixed contacts; and the switch module has at least one lower distribution plate that is movably connected with at least one of the guide rails.

The switch assembly according to the invention with the replaceable switch modules offers a particularly large number of advantages. This switch assembly is compact, thus uses less installation space and is therefore particularly simple to transport before placing in operation. By virtue of this compactness, in addition significantly less insulating medium and cooling medium are needed. The possibility of individually exchanging switch modules saves not only costs, but also time. Through the detachable arrangement, the switch modules in the case of repair or maintenance can be simply withdrawn from the housing and replaced by new ones.

The switch assembly can be constructed in any desired mode and manner, for example as an on-load tap changer for tapped transformers in the low-voltage, medium-voltage and high-voltage fields, as well as a tap changer for tapped transformers in energy mains or smelting furnace applications.

Each fixed contact and each movable contact can be constructed in any desired mode and manner and, for example, consist of one or more parts and be fastened directly in the housing or to a separate wall or directly to the switch module. Moreover, each fixed contact and each movable contact can have on the inward side several resiliently mounted contact fingers arranged above and adjacent to one another. Each fixed contact is formed in correspondence with the associated movable contact and ensures an interlocking, frictional and electrically conductive connection between the two.

The movable connection between the housing and the switch module can be constructed in any desired mode and manner, for example by the friction between distribution plate and a guide rail or by rollers at the switch module or in the housing.

The housing can be constructed in any desired mode and manner, for example as a tank consisting of metal or plastic.

It can be provided that each fixed contact has a first end and a second end and the first end is inside the housing and the second end outside the housing.

Provision can be made for the switch module to comprise at least one tie rod, at least one upper clamping plate, at least one lower clamping plate, at least one lower clamping plate and at least one switch-module stack.

Each tie rod can be constructed in any desired mode and manner, for example from glass fiber-reinforced synthetic material, plastic or other insulating material.

It can be provided that the switch-module stack has at least one switch and at least one cooling box.

Each switch of the switch-module stack can be constructed in any desired mode and manner and comprise, for example, at least one semiconductor wafer cell that has, in particular, at least one thyristor and/or at least one IGBT. Moreover, the switches can be interconnected in parallel or in series.

It can be provided that the switch module has an upper distribution plate and the movable contact is at a contact board, wherein the movable contact is electrically conductively connected with a switch-module stack.

The distribution plate can be constructed in any desired mode and manner and consist of, for example, glass fiber-reinforced synthetic material, plastic or other insulating material.

It can be provided that each movable contact has opposite contact fingers that are resiliently mounted and that when contacting a first end of the fixed contact enter into a mechanically positive connection with the fixed contact.

Provision can be made for a pressure distributor to be arranged between each switch-module stack and the upper clamping plate.

It can be provided that the pressure distributor has a flange and a thread;

a plate spring support is in the upper clamping plate;

plate springs are between the flange and the plate spring support; and a force is exerted on the pressure distributor and thus on the switch-module stack by the plate springs;

Provision can be made for at least one slide rail to be arranged on the lower face of the first distribution plate.

Each slide rail can be constructed in any desired mode and manner and consist of, for example, Teflon or another material having a low coefficient of friction.

It can be provided that the switch assembly is constructed as an on-load tap changer and is provided or constructed for switching on or switching off windings of a control winding of a tapped transformer under load.

BRIEF DESCRIPTION OF THE DRAWING

The invention and its advantages are described in more detail in the following with reference to the accompanying drawings, in which.

Figure 1:
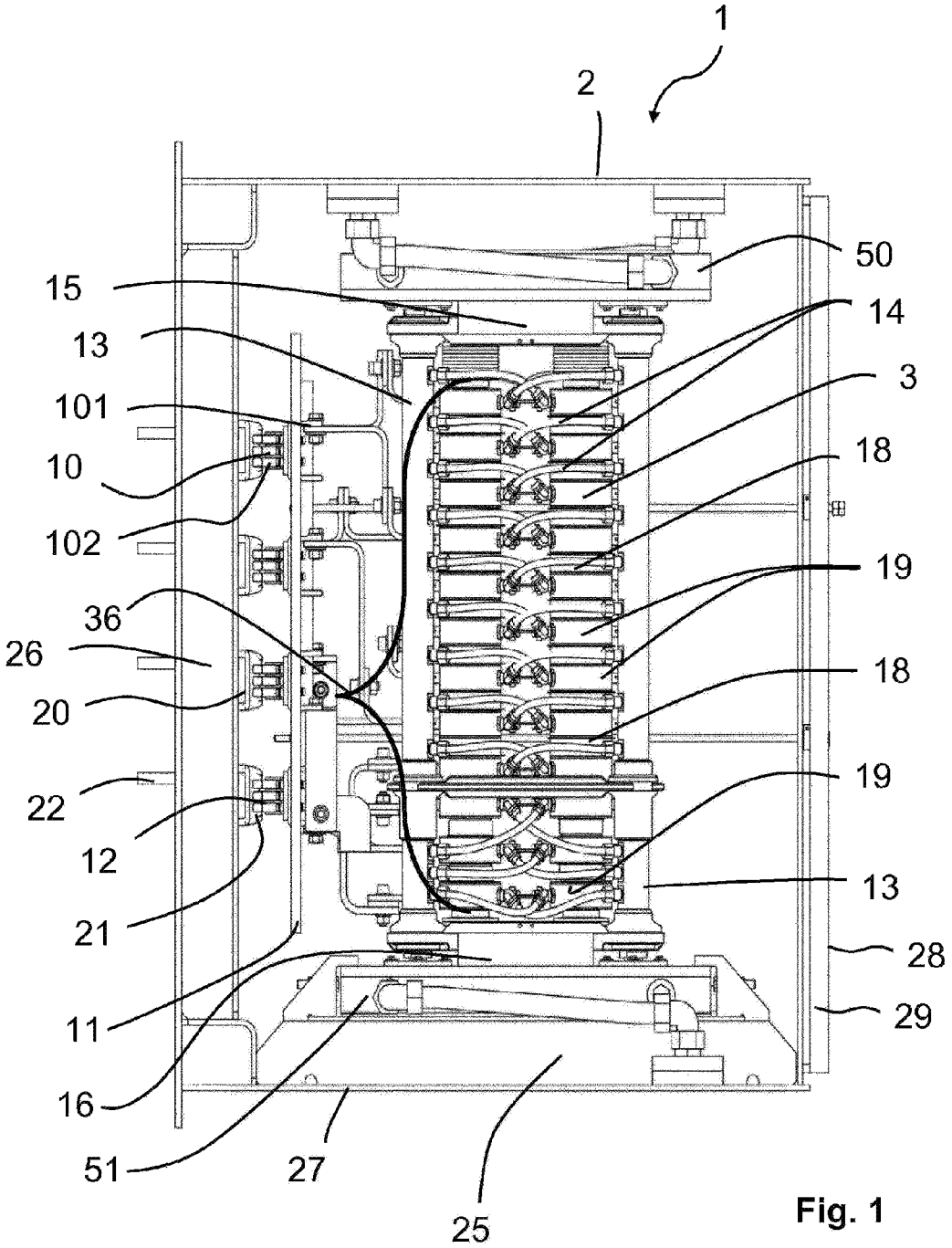
FIG. 1 shows a switch assembly with a replaceable switch module.

Identical reference numerals are used for the same or equivalent elements of the invention. In addition, for the sake of clarity only reference numerals are illustrated in the individual figures that are required for description of the respective figure. The illustrated embodiments merely represent examples of how the switch assembly with replaceable switch module can be and thus do not represent a definitive limitation of the invention.

SPECIFIC DESCRIPTION OF THE INVENTION

FIG. 1 shows the interior of a switch assembly 1 according to the invention, particularly an on-load tap changer, with a replaceable switch module 3. The switch module 3 has switches 18 serving for switching over from one winding tap to an adjacent winding tap of a control winding in a tapped transformer. The switches 18 are constructed as semiconductor wafer cells, for example thyristors, IGBTs, etc. Cooling boxes 19 are between the switches 18 and thermally, mechanically and electrically conductively connected therewith. The switches 18 and cooling boxes 19 in alternation form a switch-module stack 36, of which each switch module 3 can comprise four pieces. The switch-module stacks 36 are between an upper clamping plate 15 and a lower clamping plate 16. In addition, eight tie rods 13 are mounted between the clamping plates 15, 16. The cooling boxes 19 have, internal cooling channels (not illustrated here) that are hydraulically connected by lines 14 with one another and with the tie rods 13 of hollow construction. An upper distribution plate 50 is above the upper clamping plate 15 and a lower distribution plate 51 is below the lower clamping plate 16.

Figure 4A:
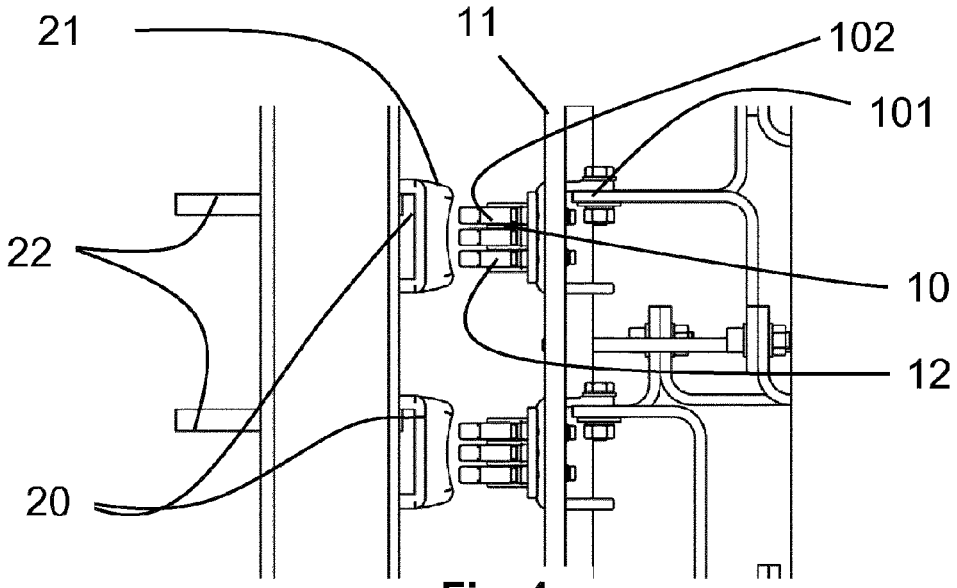
FIG. 4*a* shows a detail view of a fixed contact and a movable contact.
Figure 4B:
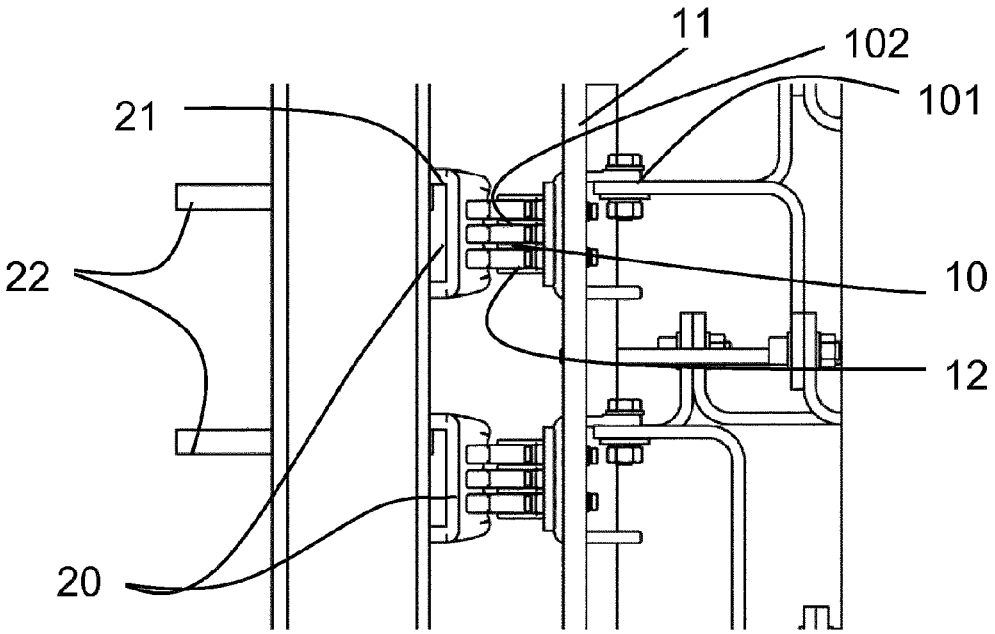
FIG. 4*b* shows a further detail view of the fixed contact and the movable contact.

The switches 18 can be connected on the one hand with one another in parallel or in series and on the other hand with the rear side 101 of the movable contacts 10. The movable contacts 10 are, in addition, in a contact board 11. In the form of embodiment illustrated here eight movable contacts 10 are mounted adjacent to and one above the other in the contact board 11. The front side 102 of each individual movable contact 10 consists of a plurality of contact fingers 12 that are one above and adjacent to another and are resiliently mounted in such a way that in each instance two contact fingers exert a force in mutually opposite directions (FIGS. 4*a* and 4*b*).

The housing 2 has, on the rear wall 26, a plurality of fixed contacts 20 that extend from the inside to the outside. The first ends 21 of the fixed contacts 20 are in that case arranged within and the second ends 22 outside the housing 2. Guide rails 25 are fastened inside the housing 2 on the base 27. The front side 28 of the housing 2 is open and is closable by a cover 29. The second ends 22 of the fixed contacts 20 are connected by lines with a control winding 4 shown schematically in FIG. 3 with different winding taps of a tapped transformer. An ester for cooling and insulation fills the interior of the housing 2.

Figure 2:
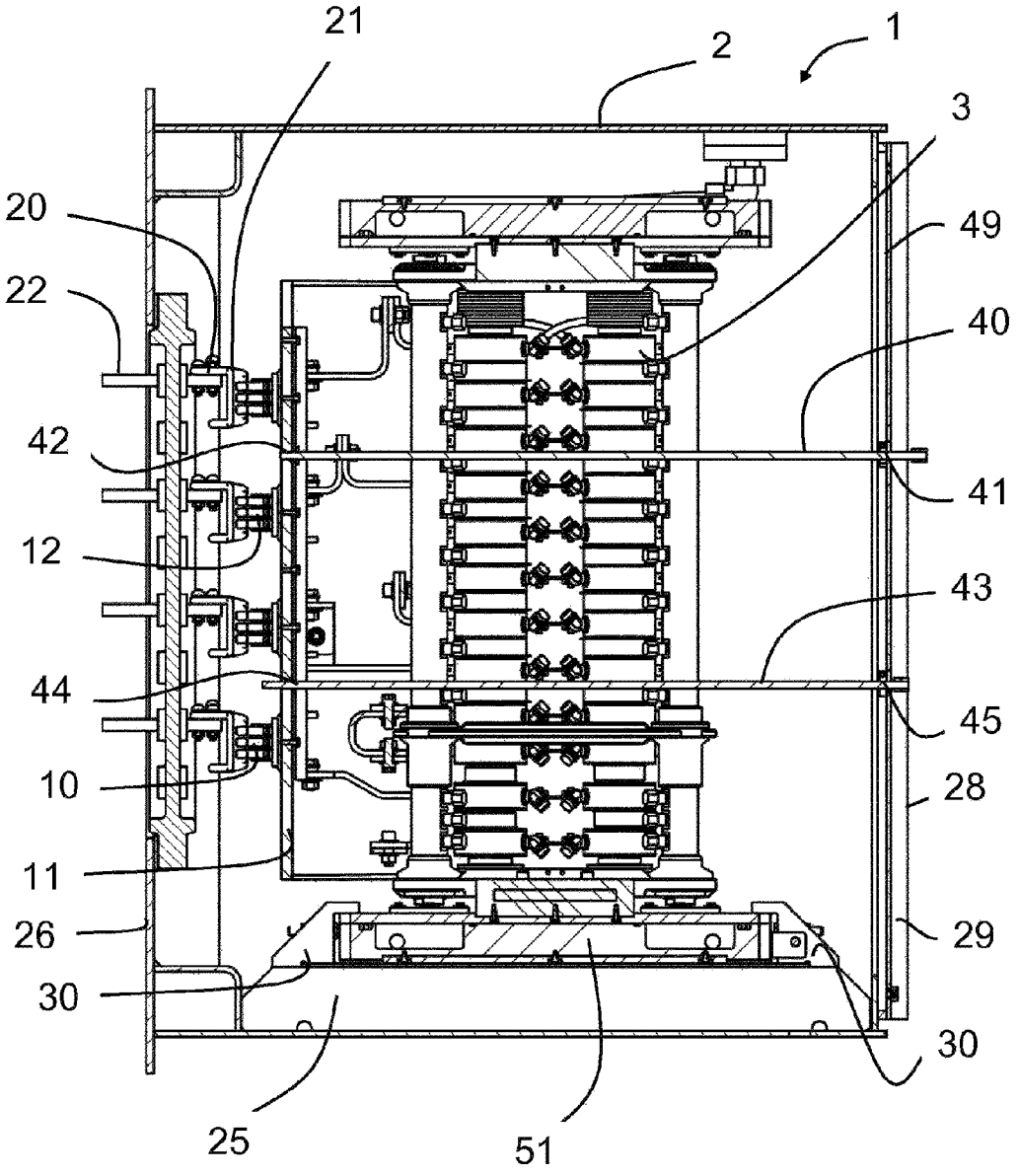
FIG. 2 shows a switch assembly with a switch module in section.

A sectional view of the switch assembly 1 is illustrated in FIG. 2. The switch module 3 is located inside the housing 2. In that case the switch module 3 rests on the guide rail 25 and is held by fixing means 30 above the lower distribution plate 51. The contact fingers 12 of the movable contacts 10 are mechanically and electrically conductively connected with the first ends 21 of the fixed contacts 20, thus switched on. The electrically conductive connection between the movable contacts 10 and the fixed contacts 20 is constantly ensured by this mechanical connection, thus the taps of the control winding of a tapped transformer and the switches 18 of the on-load tap changer.

A first spindle 40 is used for connecting the movable contacts 10 with the fixed contacts 20, thus at the time of insertion of the switch module 3. The first spindle 40 on the one hand lies on the first counter-bearing 41 at the front side 28 and on the other hand is guided in a first movable bearing 42 in the contact board 11 of the switch module 3. The switch module 3 is urged in the direction of the back wall 26 by rotation of the first spindle 40. The movable contacts 10 are pressed onto the fixed contacts 20. The first counter-bearing 41 is in that case in a strut 49 of the housing 2.

A second spindle 43 is used for releasing the movable contacts 10 from the fixed contacts 20, thus for removal of the switch module 3. The second spindle 43 on the one hand is guided in a second movable bearing 45 at the front side 28 and on the other hand rests in a second counter-bearing 44 in the contact board 11 of the switch module 3. The switch module 3 is drawn in the direction of the front side 28 by rotation of the second spindle 43. The movable contacts 10 are withdrawn from the fixed contacts 20.

The second movable bearing 45 is in that case in the strut 49 of the housing 2. The first and second spindles 40, 43 can be removed after insertion into or after withdrawal from the switch assembly 1.

Figure 3:
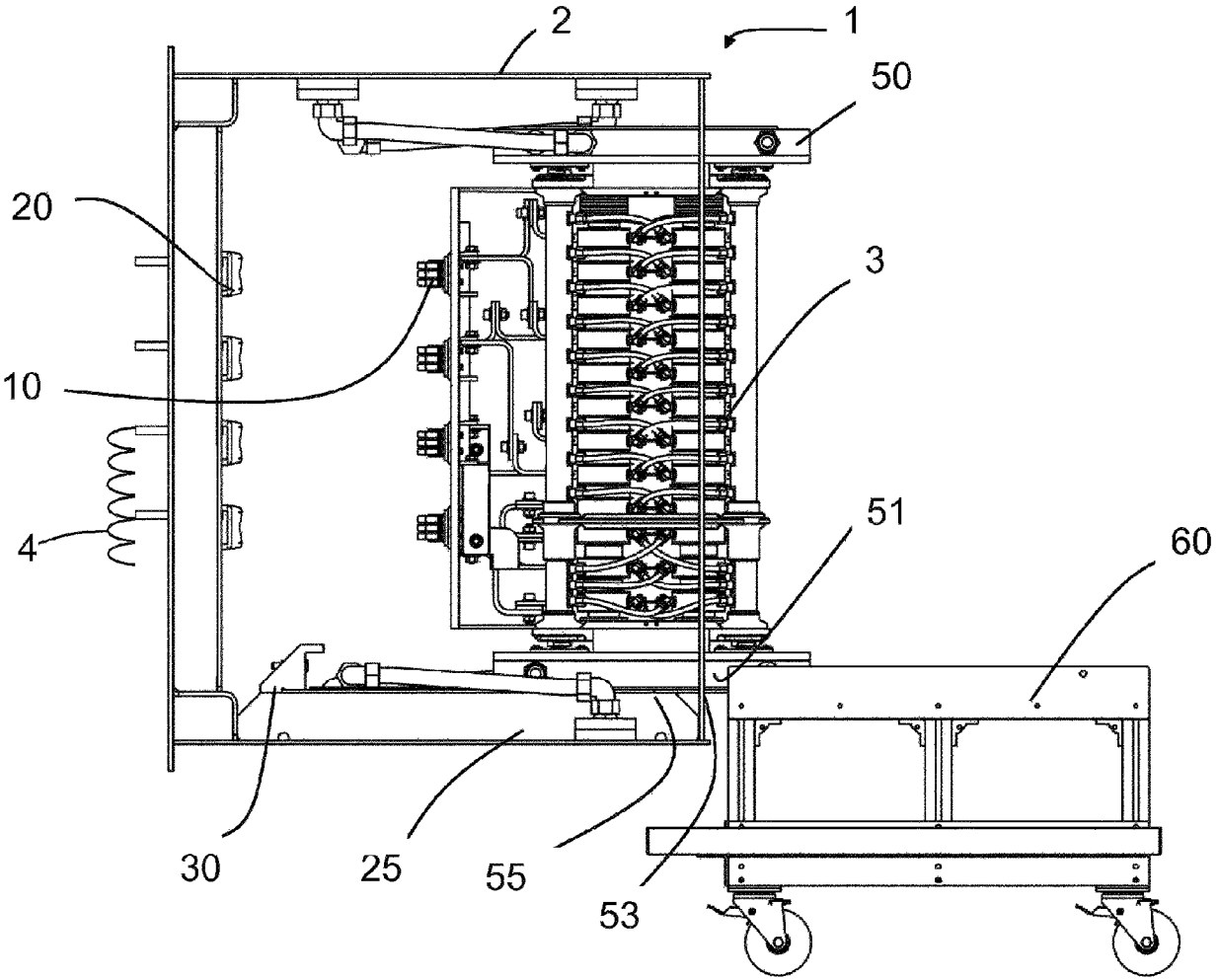
FIG. 3 shows a switch assembly with half-inserted switch module.

FIG. 3 shows the switch assembly 1 in which the switch module 3 is pushed into the housing 2 to the extent of a half. In that case, the switch module 3 slides out or in over the lower distribution plate 51 at the guide rails 25. In order to reduce friction between the lower distribution plate 51 and the guide rail 25 at least one slide rail 55 is on the lower face 53 of the lower distribution plate 51. This rail 55 is preferably constructed from Teflon or another friction-reducing material. After withdrawal of the switch module 3, this can be pushed onto a transport aid 60, here constructed as an assembly carriage. During insertion, the switch modules 3 can be simply pushed from the assembly aid 60 over the guide rail 25 in connection with the slide rail 55 into the interior of the housing 2.

FIG. 4*a* shows, in a detail view, two movable contacts 10 of the switch module 3 and the fixed contacts 20, which are fastened in the rear wall 26 of the housing 2, in the state of not being connected or switched on. When pushing-in of the switch module 3 takes place the contact fingers 12 are pushed onto the fixed contact 20 at the front side 102 of the movable contact 10 and spread apart due to the resilient mounting. By virtue of this mechanical connection, the electrical connection between the movable contacts 10 and the fixed contacts 20 is always ensured.

FIG. 4*b* shows, in a detail view, the movable contacts 10 and fixed contacts 20 in a switched-on state. In that case, a frictional and mechanically positive connection between each fixed contact 20 and movable contact 10 arises.

Figure 5:
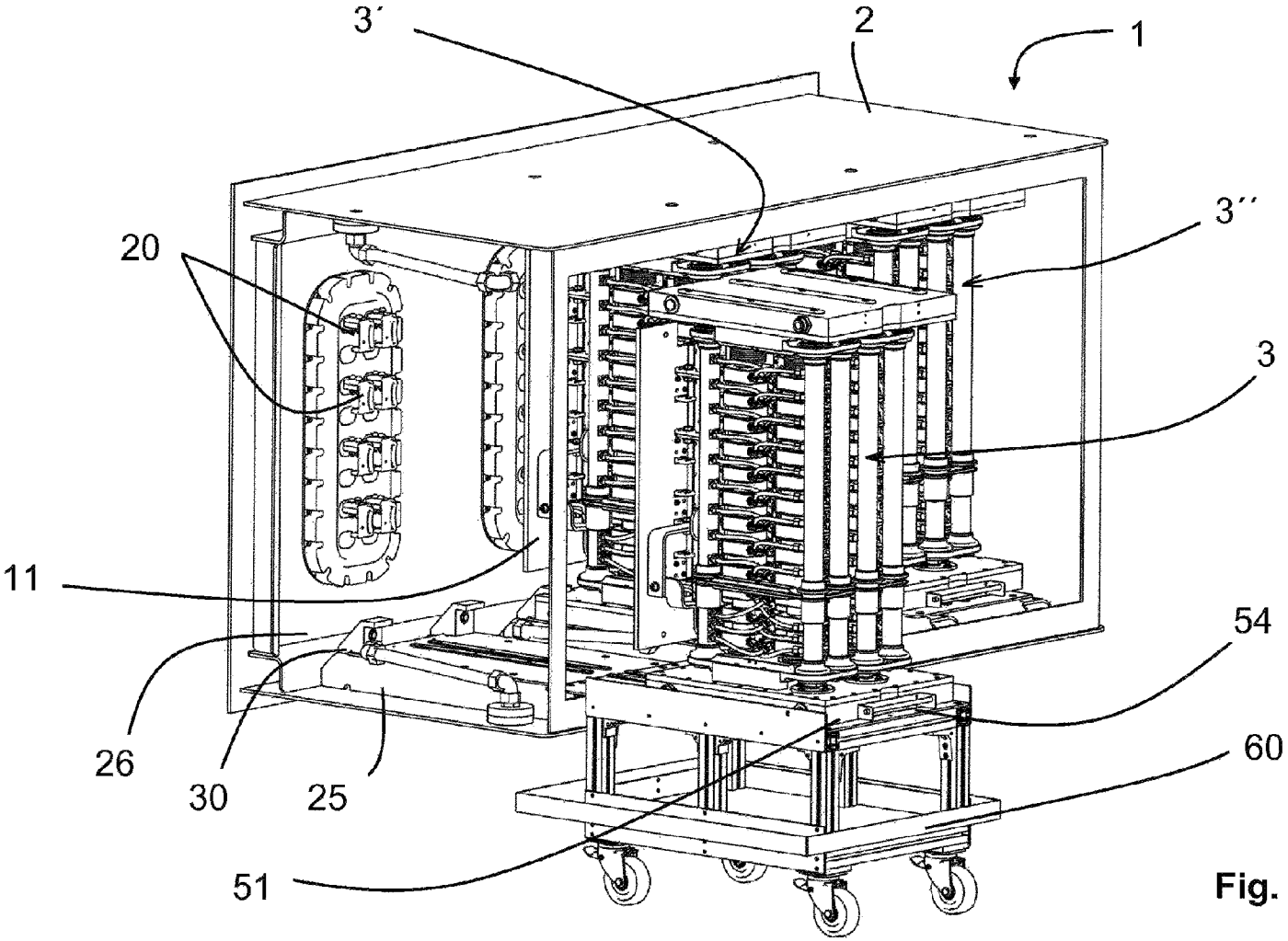
FIG. 5 shows a switch assembly with three switch modules.

FIG. 5 shows a switch assembly 1 with three replaceable switch modules 3, 3', 3" that are each associated with at least one respective control winding of a phase of a tapped transformer. One of the switch modules 3 is outside the housing 2 on a transport aid 60. A handle 54, by which withdrawal from the switch module 3 is facilitated, is at the lower distribution plate 51.

Figure 6:
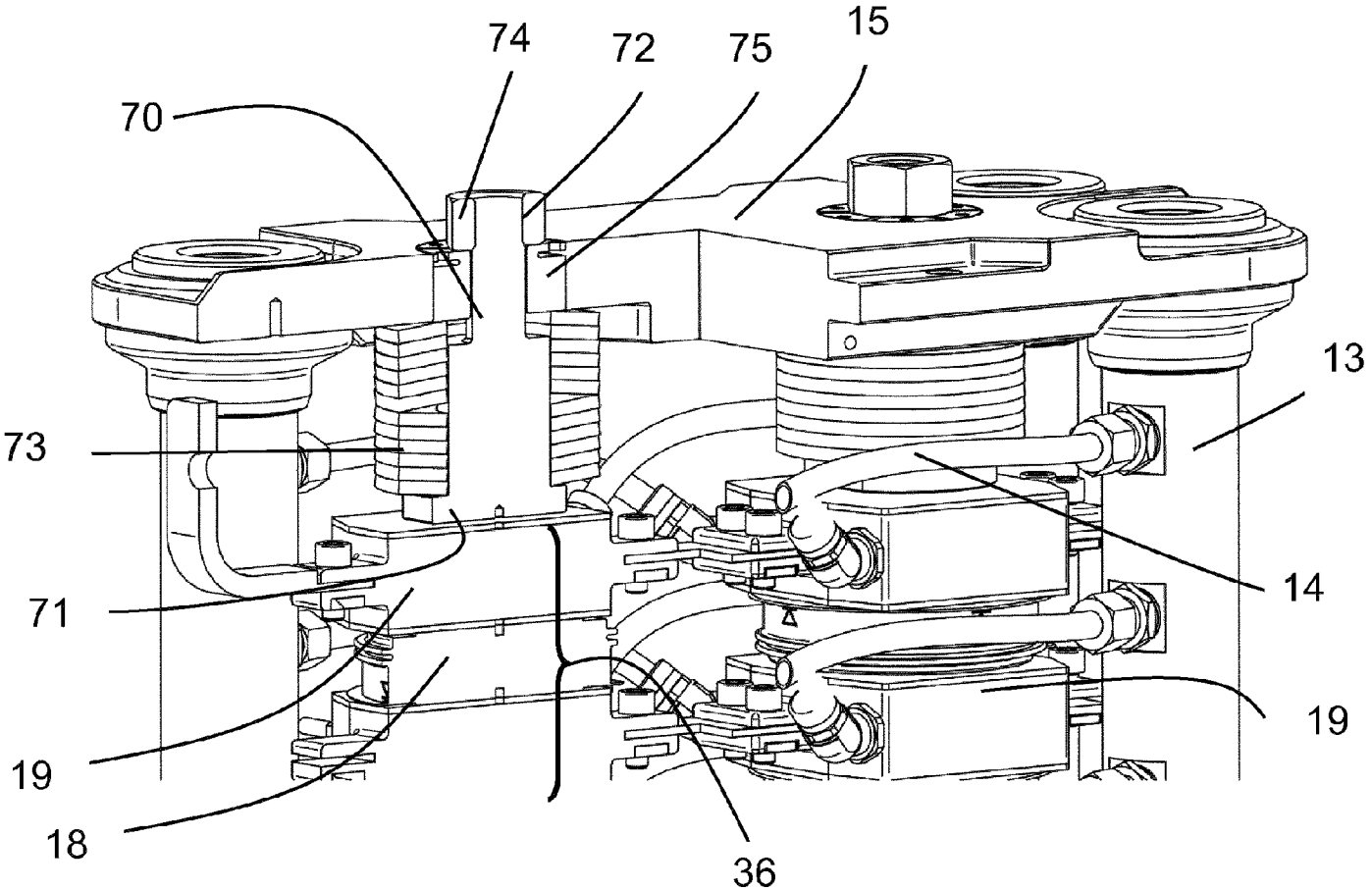
FIG. 6 shows a clamping subassembly of the switch

FIG. 6 shows a detailed view of the switch module 3. In order to be able to fix the switch-module stacks 36 in the switch module 3 a pressure distributor 70 is introduced between the uppermost cooling box 19 and the upper clamping plate 15. The pressure distributor 70 has a flange 71 in the region facing the cooling box 19. The upper region of the pressure distributor 70 has a thread 72, at the upper end of which a screw nut 74 is. Plate springs 73 and a plate spring support 75 are between the flange 71 and the screw nut 74. The pressure distributor 70 is inserted in advance, under a press, at a defined biasing force needed for the switch module 3. The plate springs 73 are pressed, during tightening, by the plate spring support 75 against the flange 71 and locked by the screw nut 74. The pressure distributor 70 is screwed by the plate spring support 75 into the clamping plate 15 until the pressure distributor 70 bears against the uppermost cooling box 19 of the switch-module stack 36. The pressure distributors 70 are subsequently locked and secured against rotation. The defined biasing of the plate springs 73 is transmitted to the switch-module stack 36 through loosening the screw nut 74.

Since each switch-module stack 30 is tightened by a separate pressure distributor 70, the two switch-module stacks 36 are mechanically decoupled from one another and compensation for differences in height can thus be provided.

In a form of embodiment (not illustrated here) the plate spring support 75 can have a larger diameter than the plate spring 73 and the flange 71 of the pressure distributor 70. In the case of servicing, the pressure distributor 70 can be unscrewed upwardly out of the upper clamping plate 15 and the biasing force on the switch-module stacks 36 thus released. Individual switches 18 can thus be exchanged without the entire switch module 3 having to be completely broken down.

The invention claimed is:

1. A switch assembly for an on-load tap changer, the assembly comprising:

a housing;

a replaceable switch module having an upper distribution plate;

a fixed contact inside the housing;

a guide rail inside the housing;

a movable contact in the switch module, releasably connectable with the fixed contact at a contact board, and electrically conductively connected with a switch-module stack; and a lower distribution plate on the switch module and movably connected with the guide rail.

2. A switch assembly for an on-load tap changer, the assembly comprising:

a housing;

a replaceable switch module having a tie rod, an upper clamping plate, a lower clamping plate, and a switch-module stack;

a fixed contact inside the housing;

a guide rail inside the housing;

a movable contact in the switch module and releasably connectable with the fixed contact; and a lower distribution plate on the switch module and movably connected with the guide rail.

3. The switch assembly according to claim 2, wherein the fixed contact has a first end inside the housing and a second end outside the housing.

4. The switch assembly according to claim 2, wherein the switch-module stack has a switch and a cooling box.

5. The switch assembly according to claim 2, further comprising:

a pressure distributor between each switch-module stack and the upper clamping plate.

6. The switch assembly according to claim 2, wherein the pressure distributor has a flange and a thread;

a plate spring support is in the upper clamping plate;

plate springs are between the flange and the plate spring support; and a force is applied by the plate springs to the pressure distributor and thus to the switch-module stack.

7. The switch assembly according to claim 2, wherein the movable contact has oppositely disposed contact fingers that are resiliently mounted and when contacting a first end of the fixed contact enter into a mechanically positive connection with the fixed contact.

8. The switch assembly according to claim 2, wherein a slide rail is on a lower face of the lower distribution plate.

9. The switch assembly defined in claim 2, wherein the switch assembly is part of the on-load tap changer and is provided or constructed for switching on or switching off windings of a control winding of a tapped transformer under load.

* * * * *